United States Patent [19]

Lin

[11] Patent Number: 4,845,968

[45] Date of Patent: Jul. 11, 1989

[54] COMBINATION LOCK

[75] Inventor: Gu-Ming Lin, Taipei, Taiwan

[73] Assignee: Echolac Co., Ltd., Taipei, Taiwan

[21] Appl. No.: 151,527

[22] Filed: Feb. 2, 1988

[51] Int. Cl.[4] ..... E05B 9/00; E05B 37/02

[52] U.S. Cl. ..... 70/312; 70/443

[58] Field of Search ..... 70/312, 67–76, 70/442, 443

[56] References Cited

U.S. PATENT DOCUMENTS 3,555,860 1/1971 Atkinson ..... 70/312
3,695,072 10/1972 Millette ..... 70/312
3,952,561 4/1976 Bako ..... 70/312
4,671,088 6/1987 Jeang ..... 70/312
4,679,419 7/1987 Scelba ..... 70/312

*Primary Examiner*—Robert L. Wolfe
*Attorney, Agent, or Firm*—Michael N. Meller

[57] ABSTRACT

A combination lock including a shaft with number wheels sleeved thereon, a governing plate having holes for respectively receiving the number wheels, two shaft mountings for respectively mounting thereon two ends of the shaft, and a lock housing securing thereon the two shaft mountings, and is characterized by integrally forming the two shaft mountings and the lock housing.

6 Claims, 5 Drawing Sheets

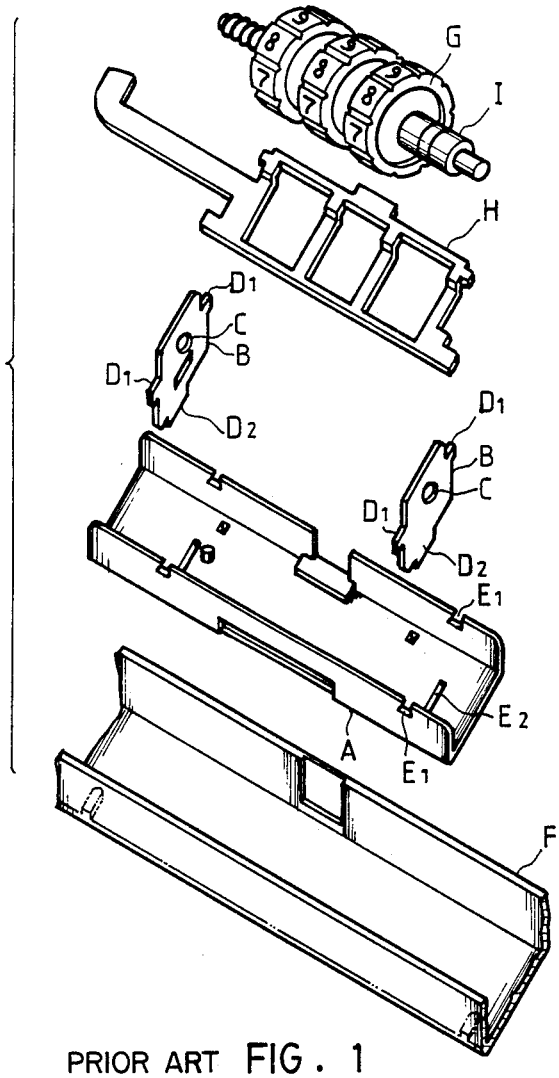
PRIOR ART FIG. 1
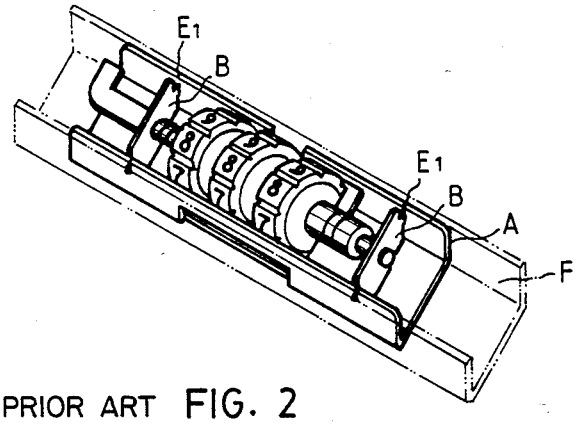
PRIOR ART FIG. 2

COMBINATION LOCK

BACKGROUND OF THE INVENTION

The present invention relates to a combination lock, and more particularly to a combination lock to be incorporated into a suitcase or a trunk.

There are numerous kinds of locks for a suitcase or a trunk. One of them, normally seen, is shown in FIG. 1. It includes a shaft I, sleeved thereon number wheels G, two shaft mountings B for respectively mounting thereon two ends of shaft I, a lock housing A securing thereon shaft mountings B, and a lock casing F provided in the suitcase or trunk for receiving therein lock housing A. Upon assembly, the two ends of shaft I are first inserted into holes C on shaft mountings B, and then, when shaft I and shaft mountings B are assembled, they are carefully put into lock housing A with protrusions D1, D2 of shaft mountings B correctly inserted into grooves E1, E2 respectively of lock housing A. Since iron lock housing A and shaft mountings B need to be separately manufactured and furthermore, since their satisfactory assembly cannot be easily obtained, it is therefore the object of this invention to overcome these shortcomings encountered in the prior art.

SUMMARY OF THE INVENTION

The object of the present invention is to provide a combination lock for a suitcase or a trunk, which provides an intergral lock housing and shaft mountings so as to simplify the manufacturing and assembly of the combination lock and to reduce its cost.

According to the present invention, a combination lock includes a shaft with number wheels sleeved thereon, a governing plate having holes respectively receiving the number wheels, two shaft mountings respectively mounting thereon two ends of the shaft, and a base member integrally formed with the two shaft mountings. Base member may be a lock housing which is received in a lock casing; the base member may otherwise be a lock casing.

The present invention may best be understood through the following description with reference to the accompanying drawings, in which:

BRIEF DESCRIPTION OF THE DRAWING

FIG. 1 is an exploded view showing the main parts of a conventional (or prior art) combination lock for a suitcase or a trunk.

FIG. 2 is a perspective view showing an assembled combination lock according to FIG. 1.

DETAILED DESCRIPTION OF THE PREFERRED EMBODIMENTS

Figure 4A:
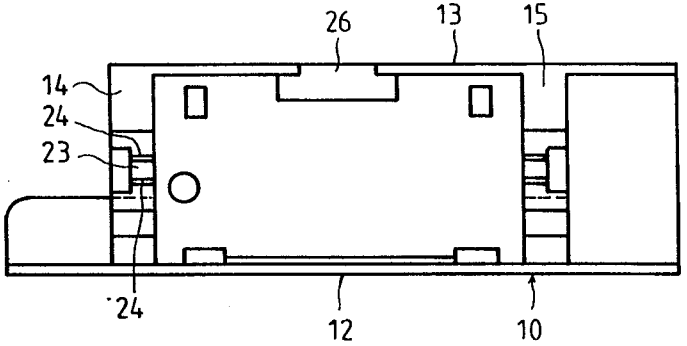
FIG. 4A is a top view showing an integral lock housing and shaft mountings according to FIG. 3.
Figure 5A:
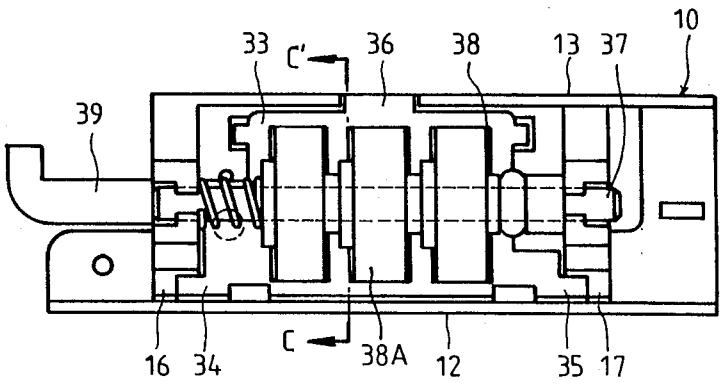
FIG. 5A is a top view showing a combination lock incorporating an integral lock housing and shaft mountings according to FIG. 3.

Referring now to FIGS. 3–6, there is shown a first embodiment of an integral lock housing and shaft mountings according to the present invention, and a combination lock incorporating the integral lock housing and shaft mountings which includes a shaft 37 and three number wheels 38A sleeved thereon, a governing plate 33 having three holes for respectively receiving number wheels 38A, two shaft mountings 14, 15 respectively mounting thereon two ends of shaft 37, shaft mountings 14, 15 being integrally formed with lock housing 10, and a lock casing 40 (see FIG. 6) in a suitcase or a trunk to receive therein lock housing 10. The number wheels 38A are arranged in the same manner as the conventional combination lock of FIG. 1. The integral lock housing and shaft mountings is preferably made of plastic.

Figure 3:
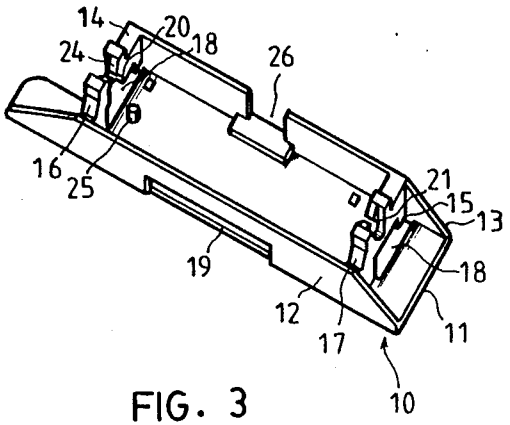
FIG. 3 is a perspective view showing a first embodiment of an integral lock housing and shaft mountings of a combination lock according to the present invention.
Figure 4B:
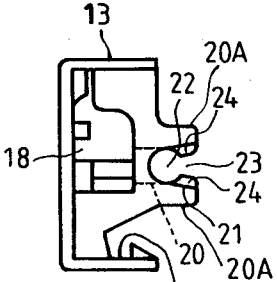
FIG. 4B is a side view showing an integral lock housing and shaft mountings according to FIG. 3.
Figure 6:
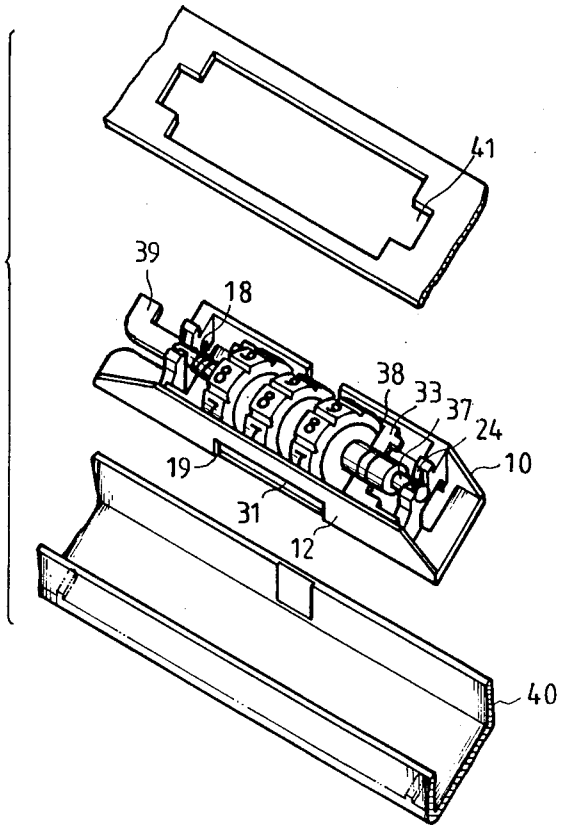
FIG. 6 is a partly exploded view showing a combination lock incorporating an integral lock housing and shaft mountings according to FIG. 3.
Figure 5B:
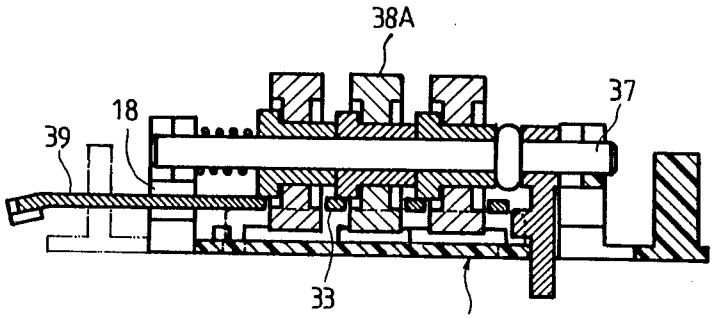
FIG. 5B is a longitudinal cross-sectional view showing a combination lock incorporating an integral lock housing and shaft mountings according to FIG. 3.
Figure 5C:
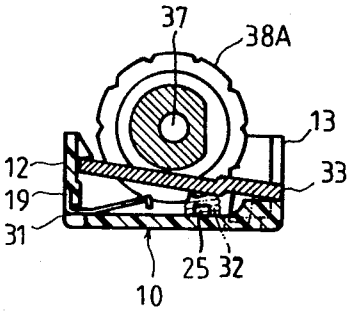
FIG. 5C is a transverse, cross-sectional view showing a combination lock incorporating an integral lock housing and shaft mounting according to FIG. 3.

As shown in FIG. 3, lock housing 10 mainly includes a bottom plate 11 and two vertical side walls 12, 13. Each one of shaft mountings 14, 15 includes a bottom through hole 18 for passing a tongue 39 of governing plate 33, a pair of top projections 20A (FIG. 4B), and an inverted U-shaped indentation 20 on the inner side of each shaft mounting and a U-shaped indentation 21 on the outer side of each shaft mounting whereby indentations 20, 21 cooperate to form a through hole 22 (best seen in FIG. 4B) in the area where they overlap, and a convergent opening 23 beginning from the top side of the top projections 20A, and communicating with the top end of inverted U-shaped indentation 20 so that each end of shaft 37 can be pressed through convergent opening 23 and retained in through hole 22 by clamping ribs 24 formed on the inner walls of top projections 20A. Each shaft mounting 14, 15 has one side flush with vertical wall 13 and the other side provided with a groove 16, 17.

Upon assembly, a bent end of a plate spring 31 is inserted in a hole 19 in vertical wall 12 of lock housing 10 (FIG. 5C), compression spring 32 is sleeved on projection 25 of lock housing 10, and then governing plate 33 is placed in position with pivoting ends 34, 35 (FIG. 5A) on one side thereof positioned in grooves 16, 17 and a protrusion 36 on the other side thereof guided in an opening 26 on vertical wall 13. Then, two ends of shaft 37 with number wheels sleeved thereon are pressed through convergent openings 23 of shaft mountings 14, 15 and retained in through holes 22 with the lower portion of the number wheels received in holes 38 of governing plate 33. Finally, lock housing 10 is placed in lock casing 40 in the suitcase or trunk. In order to assist ribs 24 in clamping the shaft ends in through holes 22, the suitcase (trunk) frame is provided with two holes 41 for compactly receiving therein top projections 20A of shaft mountings 14, 15.

Figure 7:
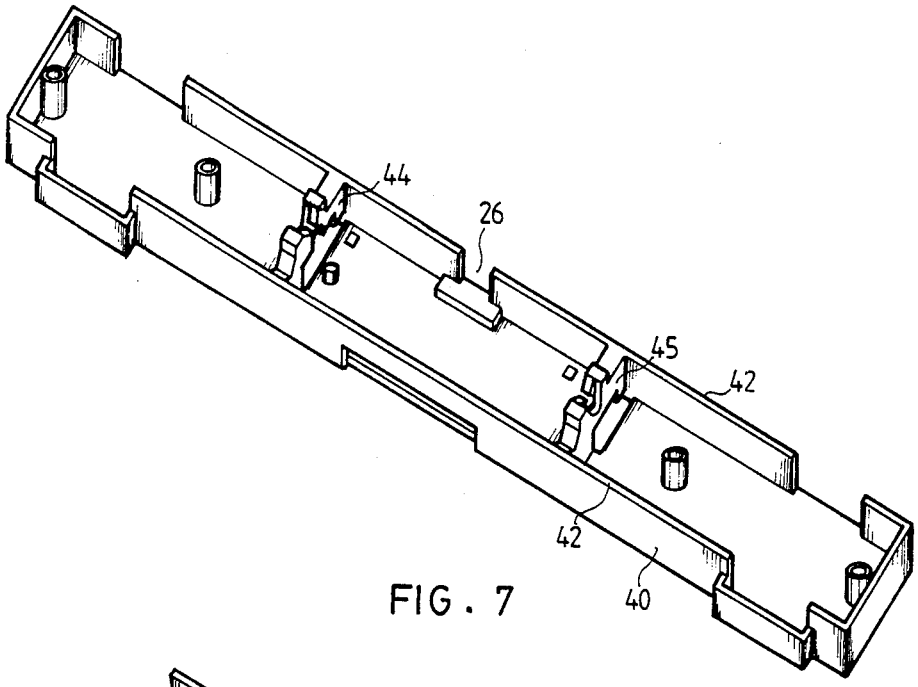
FIG. 7 is a perspective view showing a second embodiment of an integral lock casing and shaft mountings of a combination lock according to the present invention.

Referring to FIG. 7, there is shown a second preferred embodiment of an integral lock casing and shaft mountings according to the present invention.

In this embodiment the shaft mountings are integrally formed with the lock casing so as to eliminate the lock housing.

The integral lock casing and shaft mountings in this embodiment includes a lock casing 40 having two vertical walls 42 and two shaft mountings 44, 45 the same as shaft mountings 14, 15 in the preceding embodiment.

Figure 8A:
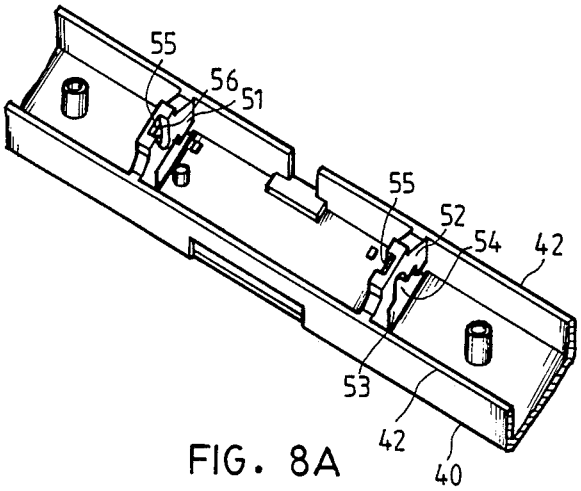
FIG. 8A is a fragmentary, perspective view showing a third embodiment of an integral lock casing and shaft mountings of a combination lock according to the present invention.
Figure 8B:
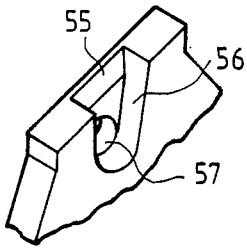
FIG. 8B is a fragmentary, partly enlarged view showing a shaft mounting according to FIG. 8A.

FIGS. 8A and 8B show a third embodiment of the present invention, which includes a lock casing 40 integrally formed with two shaft mountings 51, 52, each of which includes a bottom through hole 53 for passing a tongue of the governing plate, and a top projection which includes an inverted U-shaped indentation 54 on the outer side of each shaft mounting and a U-shaped indentation 56 on the inner side of each shaft mounting so that two indentations 54, 56 can in the area to form a through hole 57 (FIG. 8B) in the area where they overlap, and an inclined surface 55 beginning from the top side of top projections 50A on the outer side of each shaft mounting and communicating with the top portion of the inner U-shaped indentation 56 so that when one of the shaft ends is inserted into through hole 57 of one shaft mounting, the other shaft end can be pressed through inclined surface 55 and retained in through hole 57 of the other shaft mounting.

Figure 9:
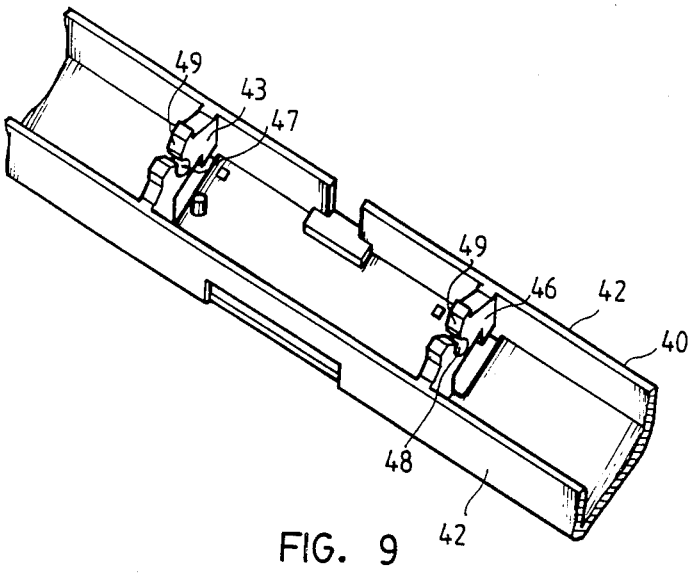
FIG. 9 is a fragmentary, perspective view showing a fourth embodiment of an integral lock casing and shaft mountings of a combination lock according to the present invention.

FIG. 9 shows a fourth embodiment of the integral lock casing and shaft mountings which includes a lock casing 40 and two shaft mountings 43, 46 each of which includes intermediate through holes 47, 48 and a pair of top projections to form a convergent opening 49 beginning from the top side of the top projections and communicating with intermediate through holes 47, 48 so that one shaft end can be pressed through convergent opening 49 and retained in the corresponding intermediate through hole 47 (48).

Figure 10:
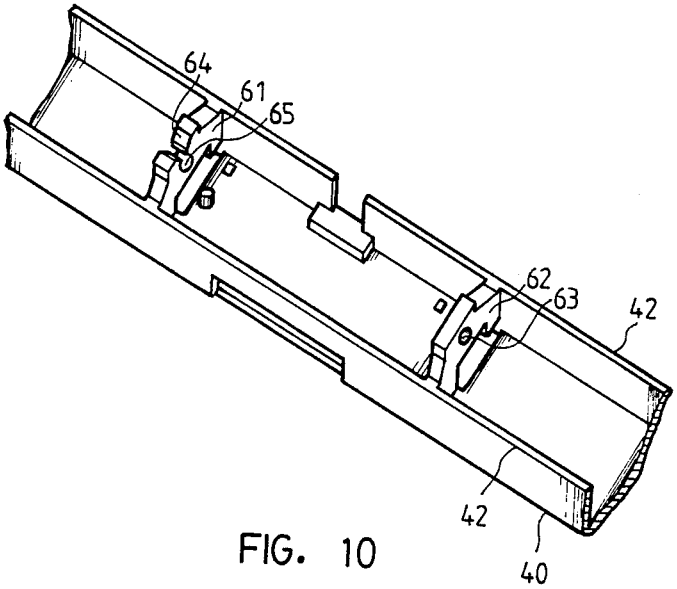
FIG. 10 is a fragmentary, perspective view showing a fifth embodiment of an integral lock casing and shaft mountings of a combination lock according to the present invention.

FIG. 10 shows a fifth embodiment of the integral lock casing and shaft mountings according to the present invention, which includes a lock casing 40 and two shaft mountings 61, 62. Shaft mounting 61 has a structure the same as that of the shaft mountings of the previous embodiment, and shaft mounting 62 merely includes an intermediate through hole 63. Upon assembly, one shaft end is first inserted into intermediate through hole 63 and then the other shaft end is pressed through convergent opening 64 and retained in intermediate through hole 65.

What I claim is:

1. A combination lock comprising:

a shaft with a plurality of number wheels sleeved thereon, a governing plate having a plurality of holes for respectively receiving said number wheels, two shaft mountings for respectively mounting thereon two ends of said shaft, and a base member integrally formed with said two shaft mountings, each of said two shaft mountings being provided with a bottom through hole adapted to allow a tongue of said governing plate to pass therethrough; and a pair of top projections including an inverted U-shaped indentation on the inner side of each shaft mounting and a U-shaped indentation on the outer side of each shaft mounting whereby said two indentations cooperate to form a through hole in the area where they overlap and a convergent opening beginning from the top side of the said top projections and communicating with the top end of said inverted U-shaped indentation whereby each one of said two ends of said shaft can be pressed through said convergent opening and retained in said through holes of said top projections.

2. A combination lock as claimed in claim 1 wherein said base member is a lock housing to be mounted in a lock casing.

3. A combination lock as claimed in claim 1 wherein said base member is a lock casing to be mounted on a brief case.

4. A combination lock comprising:

a shaft with a plurality of number wheels sleeved thereon, a governing plate having a plurality of holes for respectively receiving said number wheels, two shaft mountings for respectively mounting thereon two ends of said shaft, and a base member integrally formed with said two shaft mountings, each of said two shaft mountings including:

a bottom through hole adapted to allow to tongue of said governing plate to pass therethrough; and a top projection including an inverted U-shaped indentation on the outer side of each shaft mounting and, a U-shaped indentation on the inner side of each shaft mounting whereby said two indentations cooperate with each other to form a through hole in the area where they overlap, and an inclined surface beginning from the top side of said top projection on the outer side and communicating with the top portion of said U-shaped indentation whereby when one of said two ends of said shaft is inserted into said through hole of said top projection of one of said two shaft mountings, the other end of said shaft can be pressed along said inclined surface and retained in said through hole of said top projection of the other shaft mounting.

5. A combination lock comprising:

a shaft with a plurality of number wheels sleeved thereon, a governing plate having a plurality of holes for respectively receiving said number wheels, two shaft mountings for respectively mounting thereon two ends of said shaft, and a base member integrally formed with said two shaft mountings, each of said two shaft mountings including;

a bottom through hole adapted to allow a tongue of said governing plate to pass therethrough;

an intermediate through hole adapted to mount thereon one of said two ends of said shaft; and a top projection having a convergent opening beginning from the top end of said top projection and communicating with said intermediate through hole whereby said one shaft end can be pressed through said convergent opening and retained in said intermediate through hole.

6. A combination lock comprising:

a shaft with a plurality of number wheels sleeved thereon, a governing plate having a plurality of holes for respectively receiving said number wheels, two shaft mountings for respectively mounting thereon two ends of said shaft, and a base member integrally formed with said two shaft mountings, one of said two shaft mountings including:

a first bottom through hole; and a first intermediate through hole; and the other of said two shaft mountings including:

a second bottom through hole;

a second intermediate through hole; and a top projection having a convergent opening beginning from the top side of said top projection and communicating with said second intermediate through hole whereby one of said two ends of said shaft can be pressed through said convergent opening and retained in said second intermediate through hole when the other shaft end is first inserted in said first intermediate through hole.

* * * * *